United States Patent [19]

Lundgren

[11] 4,277,224

[45] Jul. 7, 1981

[54] FAN ATTACHMENT FOR ROCKING CHAIRS

[76] Inventor: Roy L. Lundgren, 1360 NE. 48th Ct., Fort Lauderdale, Fla. 33334

[21] Appl. No.: 102,133

[22] Filed: Dec. 10, 1979

[51] Int. Cl.[3] ..... A47C 7/74

[52] U.S. Cl. ..... 416/58; 74/129; 74/136

[58] Field of Search ..... 416/56, 57, 58, 173; 74/108, 126, 129, 136; 297/180

[56] References Cited

U.S. PATENT DOCUMENTS

| | | | |
|---|---|---|---|
| 1,121,923 | 12/1914 | Hartman | 74/136 |
| 1,139,299 | 5/1915 | Kline | 416/57 |
| 1,173,043 | 2/1916 | Schroeder | 416/58 |
| 1,269,325 | 6/1918 | Singer | 416/58 |
| 1,302,010 | 4/1919 | Cattinari | 416/58 X |
| 1,328,353 | 1/1920 | Wuerth | 416/58 |

*Primary Examiner*—Leonard E. Smith
*Attorney, Agent, or Firm*—Quaintance, Murphy & Richardson

[57] ABSTRACT

A fan constructed according to the present invention has a base supporting a vertical tube having a movable vertical rod inside. The lower end of the rod is hingedly connected to a means for attaching the device to a moving part of a rocking chair, such as a rocker, seat or leg. An endless belt is connected to the top of the vertical rod for oscillating movement therewith, the belt being held in a vertical loop by a pair of wheels or gears mounted within the tube. A top wheel movable with the belt engages a set of gears in such a manner as to transform oscillatory motion of the belt into rotation of a horizontal shaft in a single direction. A set of fan blades is mounted on the horizontal shaft.

13 Claims, 5 Drawing Figures

FAN ATTACHMENT FOR ROCKING CHAIRS

BACKGROUND OF THE INVENTION

1. Field of the Invention

This invention relates to fans operated by the motion of a rocking chair, and more particularly to a lightweight fan which can be temporarily attached to a rocking chair.

2. Description of the Prior Art

Fans operated by oscilliatory movement of a rocking chair can be found in the prior art. Examples are the devices shown in U.S. Pat. No. 955,823, U.S. Pat. No. 509,926 and U.S. Pat. No. 1,173,043. However, the rocking chair fans of the prior art have been cumbersome, heavy and costly devices. Because many of them include springs or heavy weights for the rocker to overcome, they are tiring to operate. Also, rocking chair fans of the past have had gears, belts, gear racks, levers and like items exposed, thereby presenting a safety problem. Many of the past devices have been intended to be permanently attached to a rocking chair.

It is an object of the invention to provide a compact, lightweight and inexpensive rocking chair fan. It is another object of the invention to provide such a device which is easy to operate. It is a further object of the invention to provide a rocking chair fan having no exposed mechanical parts, and to provide a rocking chair fan which can be temporarily installed.

SUMMARY OF THE INVENTION

A fan constructed according to the present invention has a base supporting a vertical tube having a movable vertical rod inside. The lower end of the rod is hingedly connected to a means for attaching the device to a moving part of a rocking chair, such as a rocker, seat or leg. An endless belt is connected to the top of the vertical rod for oscillating movement therewith, the belt being held in a vertical loop by a pair of wheels or gears mounted within the tube. A top wheel movable with the belt engages a set of gears in such a manner as to transform oscillatory motion of the belt into rotation of a horizontal shaft in a single direction. A set of fan blades is mounted on the horizontal shaft.

Other features of the invention are a fan blade assembly which can be tilted and swiveled into the desired position, and a mechanism which acts as an "on-off switch" which would allow a user to rock without operating the fan. These features and others are set out in detail below.

DESCRIPTION OF A PREFERRED EMBODIMENT

Figure 1:
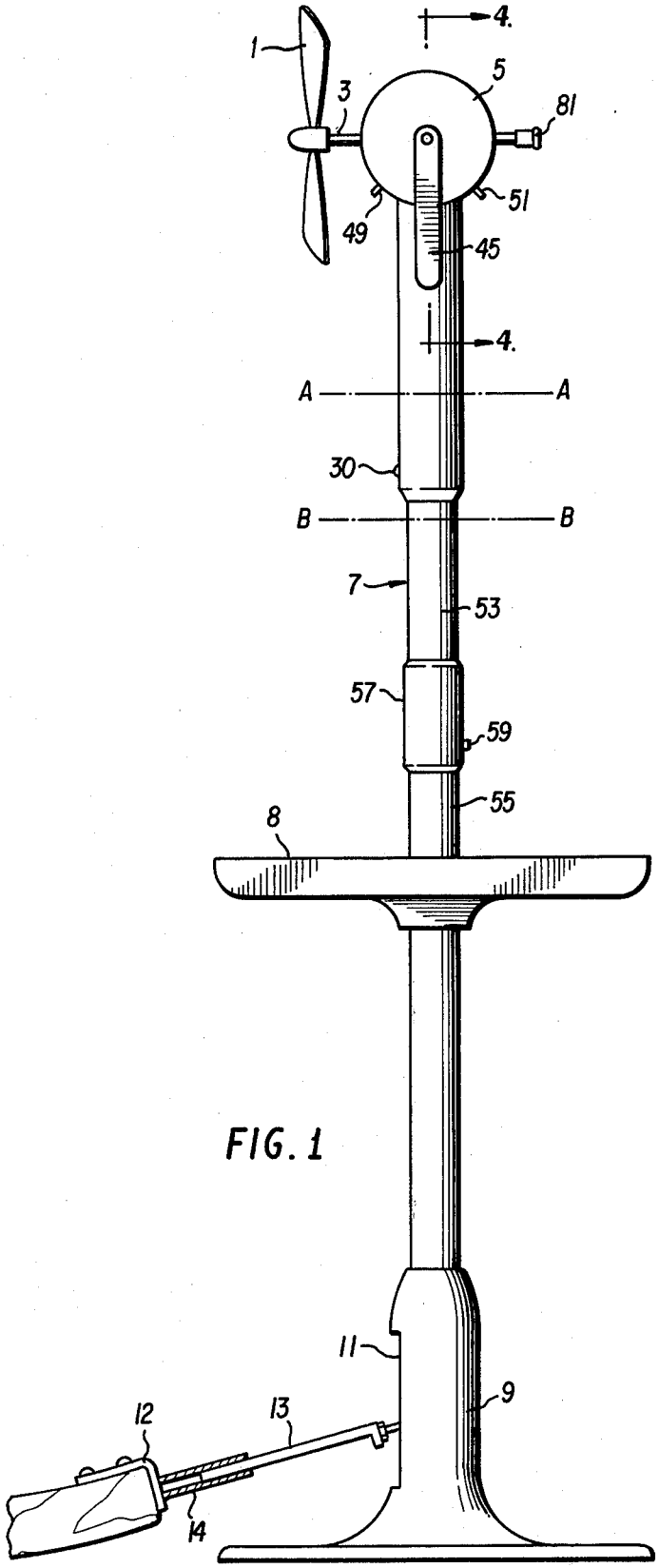
FIG. 1 is a view of the outer appearance of the invention.

Referring to FIG. 1, the fan is made up of a fan blade assembly 1 mounted on a shaft 3 which leads into a gearcase 5 mounted on a vertical tube 7 supported by a base 9. The tube 7 can have a table 8 mounted upon it. The base 9 has a slot 11. A plug 13 which serves as a means to attach the fan to a rocking chair protrudes from the slot 11. A bracket 12 can be attached to a chair in many well-known ways like, for example, attaching it with ordinary screws. The bracket 12 supports a tube 14 into which the plug 13 can be inserted. This is a preferred manner of attaching the fan to the chair, since the fan can thus easily be attached to and removed from the chair.

Figure 2:
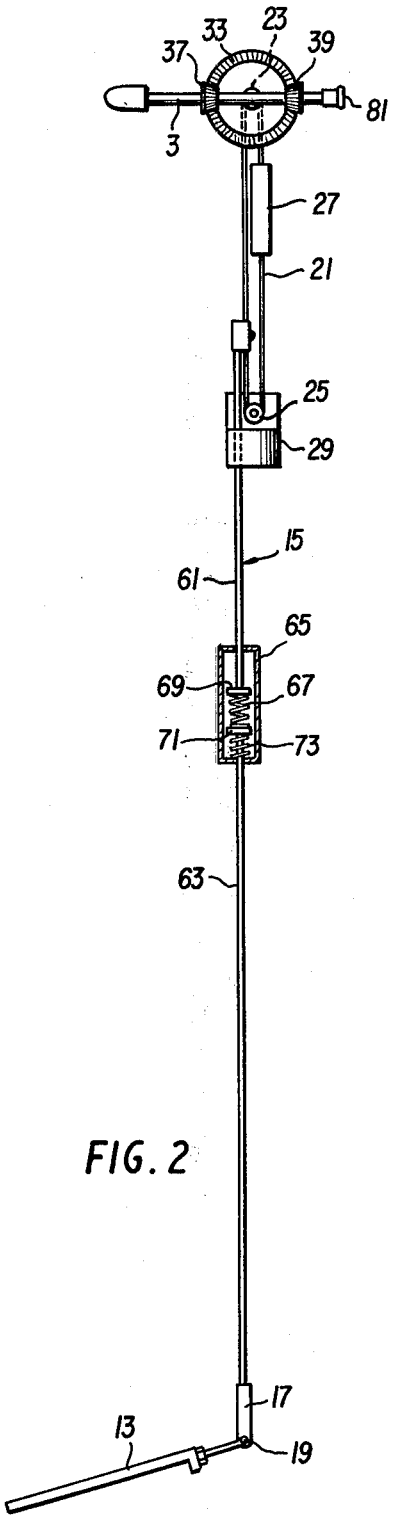
FIG. 2 is a view of the fan with outer coverings removed.

FIG. 2 shows the interior mechanism of the fan. Inside the tube 7 is a vertical rod 15. At the lower end of the rod 15 is a yoke 17 to which the handle 13 is hingedly attached, for example, by a pin 19.

At the upper end of the rod 15 is a belt 21. The belt 21 can be a timing belt, a round belt or any other suitable belt. The belt is mounted on two vertically spaced wheels 23 and 25 which hold the belt in an elongated vertical loop. If the belt 21 is a toothed timing belt, gears can be used in place of the wheels 23 and 25, and the belt 21 will be mounted with its teeth meshed with those of the gears.

The rod 15 is attached to the belt 21 along one side of the vertical loop. The means for connecting the rod 15 to the belt 21 can be any commonly known clamping or fastening means. On the other side of the loop formed by the belt 21 is a counterweight 27. The counterweight 27 has a weight equal to the rod 15, yoke 17, handle 13 pin 19 and the shock dampening assembly numbers 65, 67, 69, 71, 73, 63.

As the rocking chair rocks, the handle 13 attached to the chair causes the rod 15 to move up and down. The up and down motion of the rod 15 results in an oscillatory motion of the belt 21 about the wheels 23 and 25.

Figure 3:
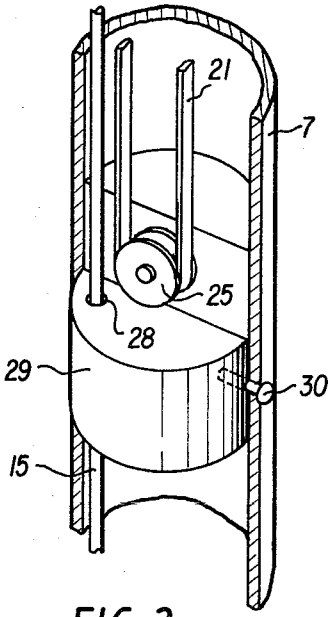
FIG. 3 is a cut-away view between lines A—A and B—B of FIG. 1.

As is shown in FIG. 3, wheel 25 is held vertically stationary by, for example, a cylinder 29 upon which the gear 25 is mounted, the cylinder 29 being held stationary relative to the tube 7 by, for example, the insertion of the pin 30 through the tube and into the cylinder 29. The cylinder 29 has a longitudinal hole 28 through it through which the rod 15 passes.

Figure 5:
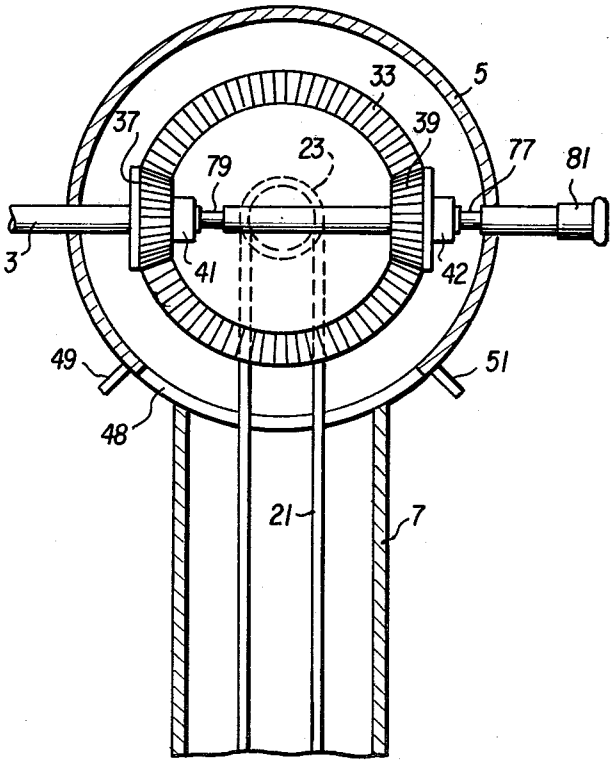
FIG. 5 is a view along line 5—5 of FIG. 4.
Figure 4:
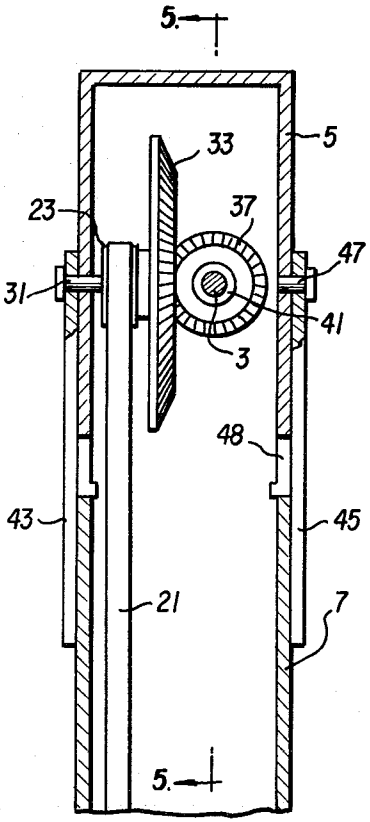
FIG. 4 is a view along line 4—4 of FIG. 1.

Referring now to FIGS. 4 and 5, the wheel 23 is held vertically stationary by a horizontal shaft 31 pressed in housing 5. The wheel 23 is attached to circular bevel gear 33 and rotate on shaft 31 by movement of belt 21.

Mounted on a second horizontal shaft 3 are bevel pinions 37 and 39. The bevel pinions 37 and 39 have their teeth meshed with those of the bevel gear 33. The pinions 37 and 39 are mounted at either end of a horizontal diameter of the circular bevel gear 33.

Between the shaft 3 and the pinion 37 is a oneway clutch 41. The clutch 41 will allow the shaft 3 to rotate with the pinion 37 in only one direction. A similar clutch 42 is engaged with pinion 39, allowing motion of the shaft 3 in the same direction as that allowed by clutch 41. Thus, the shaft 3 will continuously rotate in a single direction as the belt 21 oscillates and causes the bevel gear 33 and pinions 37 and 39 to oscillate.

Several other features in a preferred embodiment of the invention are means to tilt and swivel the fan, a shock dampening mechanism, and an on-off switch.

Referring back to FIGS. 4 and 5, tilting can be accomplished by mounting the gearcase 5 on the tube 7 with tilt tabs 43 and 45. The tilt tabs 43 and 45 are pivotally attached to the gearcase 5 by a pivot pin 47 and the outer end of shaft 31. On the bottom of the gearcase 5 is a slot 48 through which the belt 21 passes from the tube 7 into the case 5. Stops 49 and 51 are located at either end of the slot. The fan blade assembly 1 can be tilted by pivoting the gearcase 5 about the pivot pin 47. The length of the slot 48 and the location of the stops 49 and 51 define the extent to which the fan blade assembly 1 can be tilted.

The upper portion of the fan can be made to swivel about a vertical axis relative to the base. In this embodiment the tube 7 comprises an upper portion 53 and a lower portion 55. The end of the upper portion of the tube 53 and the lower portion 55 meet within a casing 57. Either the upper portion 53 or the lower portion 55 is attached to the casing 57 and held stationary relative to it. The end of the unattached portion will have a horizontal groove not shown near its end. A pin 59 inserted into the side of the casing 57 will fit into the groove, thereby holding together the casing 57 and attached portion of the tube 7, and the unattached portion while allowing the upper portion 53 and that part of the fan device above the casing 57 to swivel while the base 9 of the device stays motionless.

FIG. 2 shows the inner workings of a swivelable embodiment of the invention. In a swivelable embodiment of the invention, the rod 15 comprises an upper rod portion 61 and a lower rod portion 63. The ends of the upper rod portion 61 and lower rod portion 63 meet in a second casing 65.

A shock dampening mechanism can be provided in the second casing 65. A first helical spring 67 can be placed in the casing 65 between the ends of the upper rod portion 61 and lower rod portion 63. The upper portion 61 and lower portion 63 each have enlarged areas 69 and 71 respectively at their ends to engage the ends of the spring 67. A second spring 73 placed between the enlarged area 71 of the lower rod portion 63 and the lower end of the casing 65 completes the shock dampening mechanism for the fan.

The shock dampener will reduce the effect upon the motion of the fan blade assembly of abrupt or jerking motions of the rocking chair. However, if the belt 21 has sufficient resilience, the shock dampener contained in the casing 65 will not be necessary.

Referring now to FIG. 5, the on-off switch of the preferred embodiment comprises two notched areas 79 and 77 of the shaft 3. A button 81 is attached to the end of shaft 3 opposite the fan blade assembly 1. A person desiring to rock without operating the fan can position the button 81 so that the notched areas 79 and 77 are within the clutches 41 and 42. Since the diameter of the notched areas 79 and 77 are less than the inner diameter of the clutches 41 and 42, when the notched areas 79 and 77 are within the clutches 41 and 42 the fan blade assembly 1 is disengaged from the bevel pinions 37 and 39, and will not rotate in response to the motion of the belt 21.

What is claimed is:

1. A fan drive by the oscillatory motion of a rocking chair comprising:

a means for attaching the fan to a moving part of the rocking chair, a vertical rod hingedly connected to the attaching means, an endless belt connected to the top of the vertical rod at a point along the belt, means for holding the belt in a vertically elongated loop, the belt being free to move in response to oscillatory motion of the vertical rod, a horizontal shaft located near the upper end of the belt loop, a set of gears in engagement with the belt and the horizontal shaft, and arranged to transform oscillatory motion of the belt into continuous rotation of the shaft, fan blades mounted on the shaft, a tube covering the rod and toothed belt, a supporting base at the lower end of the tube, whereby the fan can stand vertically upright, and a casing covering the gear set.

2. A fan to be driven by the oscillatory motion of a rocking chair comprising:

a supporting base, a vertical tube mounted on the base, a vertical rod within the tube, a means for attaching the fan to a moving part of the rocking chair, the attaching means being hingedly connected to the lower end of the vertical rod, a pair of vertically spaced wheels within the tube free to rotate in a vertical plane and located near the upper end of the vertical rod, an endless belt mounted on the pair of wheels whereby the belt is held in a vertical loop by the wheels, means for connecting the vertical rod to the belt at a single point, whereby vertical oscillations of the rod result in rotational oscillations of the belt, a horizontal shaft located near the upper end of the belt loop, a set of gears in engagement with the top wheel upon which the belt is mounted and the horizontal shaft, and arranged to transform oscillatory motion of the belt into continuous rotation of the shaft in one direction, fan blades mounted on the shaft, and a casing covering the gear set.

3. The device of claim 2 wherein the attaching means comprises:

a plug hingedly connected to the lower end of the vertical rod, a bracket secured to the moving part of the rocking chair, a tube supported by the bracket into which the plug can be inserted.

4. The device of claim 2 wherein the set of gears comprises:

a circular bevel gear having its horizontal diameter running along the horizontal shaft, and oscillating with the oscillatory motion of the belt, a pair of bevel pinions mounted on the shaft and in engagement with the circular bevel gear, a pair of clutches, each clutch pressed inside one of the bevel pinions and the shaft and allowing motion of the bevel gear in one direction only.

5. The device of claim 4 further comprising:

two notched areas on the horizontal shaft, the notched areas having a diameter smaller than the inner diameter of the clutches and spaced at a distance equal to the distance between the two bevel pinions, and a spacing sleeve having a length equal to the distance between the bevel pinions and mounted over the shaft between the bevel pinions, whereby the shaft and fan blades can be disengaged from the gear set when the notched areas of the shaft are located within the clutches.

6. The device of claim 1 further comprising means to tilt the fan blades and shaft.

7. The device of claim 6 wherein the tilting means comprises:

a pair of vertical supports mounted opposite each other on the upper end of the tube and extending vertically above the tube, means to pivotally attach the gearcase and the gear set therein to the pair of supports.

8. The device of claim 1 wherein the endless belt comprises a timing belt.

9. The device of claim 8 wherein the pair of wheels upon which the belt is mounted comprises a pair of toothed gears.

10. The device of claim 9 further comprising a horizontal platform mounted on the tube.

11. The device of claim 2 wherein the vertical rod comprises two vertical shafts having their ends spaced from one another, a vertical helical spring located between the ends of the two vertical shafts, a tubular housing covering the ends of the two vertical shafts and the spring, whereby the effect of abrupt movement of the lower end of the vertical rod is dampened.

12. The device of claim 11 wherein the tube covering the rod and the belt comprises two separate tubular members meeting end to end, and a casing holding the ends of the tubular members in close proximity, whereby the upper portion of the fan can be swiveled relative to the handle and base.

13. The device of claim 11 further comprising a counterweight attached to the endless belt opposite the point where the vertical rod is attached to the belt, the counterweight having a weight equal to the combined weight of the vertical rod and attaching means.

* * * * *